US006462322B1

(12) United States Patent
Gauggel et al.

(10) Patent No.: US 6,462,322 B1
(45) Date of Patent: Oct. 8, 2002

(54) MISSILE FOR COMBATING STATIONARY AND/OR MOVING TARGETS

(75) Inventors: Roland Gauggel, Salem; Michael Arnold, Bad Reichenhall; Reinhard Krüger, Rückstetten bei Teisendorg; Norbert Tränapp, Bad Tülz, all of (DE)

(73) Assignee: LFK-Lenkflugkorpersysteme GmbH, Unterschleissheim (DE)

( * ) Notice: Subject to any disclaimer, the term of this patent is extended or adjusted under 35 U.S.C. 154(b) by 0 days.

(21) Appl. No.: 09/720,427

(22) PCT Filed: Jun. 25, 1999

(86) PCT No.: PCT/DE99/01863

§ 371 (c)(1),
(2), (4) Date: Jun. 12, 2001

(87) PCT Pub. No.: WO00/00781

PCT Pub. Date: Jan. 6, 2000

(30) Foreign Application Priority Data

Jun. 26, 1998 (DE) ..... 198 28 645

(51) Int. Cl.[7] ..... F41G 7/00

(52) U.S. Cl. ..... 244/3.1; 244/3.24; 244/3.15; 244/54

(58) Field of Search ..... 244/3.24, 3.15, 244/3.1, 23 A, 23 R, 54, 55

(56) References Cited

U.S. PATENT DOCUMENTS 4,327,885 A * 5/1982 Blevins et al. ..... 244/3.24
4,348,956 A 9/1982 Schmidlin ..... 102/377
4,364,530 A 12/1982 Ripley-Lotee et al. ..... 244/3.22
4,844,380 A 7/1989 Peoples et al. ..... 244/3.22
5,020,436 A 6/1991 Coburn ..... 102/377
5,039,030 A 8/1991 Kraus ..... 244/3.28
5,931,414 A 8/1999 Grosse ..... 244/62

FOREIGN PATENT DOCUMENTS

DE 2 201 130 7/1973
DE 38 38 737 5/1990
DE 42 39 589 5/1994
FR 2 613 824 10/1988
FR 2 658 284 8/1991

* cited by examiner

*Primary Examiner*—J. Woodrow Eldred
(74) *Attorney, Agent, or Firm*—Burns, Doane, Swecker & Mathis, LLP

(57) ABSTRACT

The invention relates to a missile for combating stationary and/or moving targets comprising a seeker head (100), an effective charge which is arranged behind said seeker head in the direction of flight, a thruster such as a solid fuel booster having lateral outlet nozzles which is arranged behind the effective charge in the direction of flight, and a guiding section (104) which is arranged behind the thruster in the direction of flight. The guiding section comprises controllable aerofoils (**105*a*, 105*b*) such as lateral and/or tail fins, and a guiding device. The missile also comprises a cruise engine (107) which is arranged on the tail, whereby the cruise engine is detachably connected to the guiding section by means of a first quick-acting closure (109*a*, 109*b*) such as a manually operable bayonet closure or the like. At least one auxiliary thruster (108**), if required, can be mounted between the guiding section and the cruise engine by means of a second quick-acting closure such as a manually operable bayonet closure or the like.

9 Claims, 2 Drawing Sheets

MISSILE FOR COMBATING STATIONARY AND/OR MOVING TARGETS

DESCRIPTION

Figure 1A:
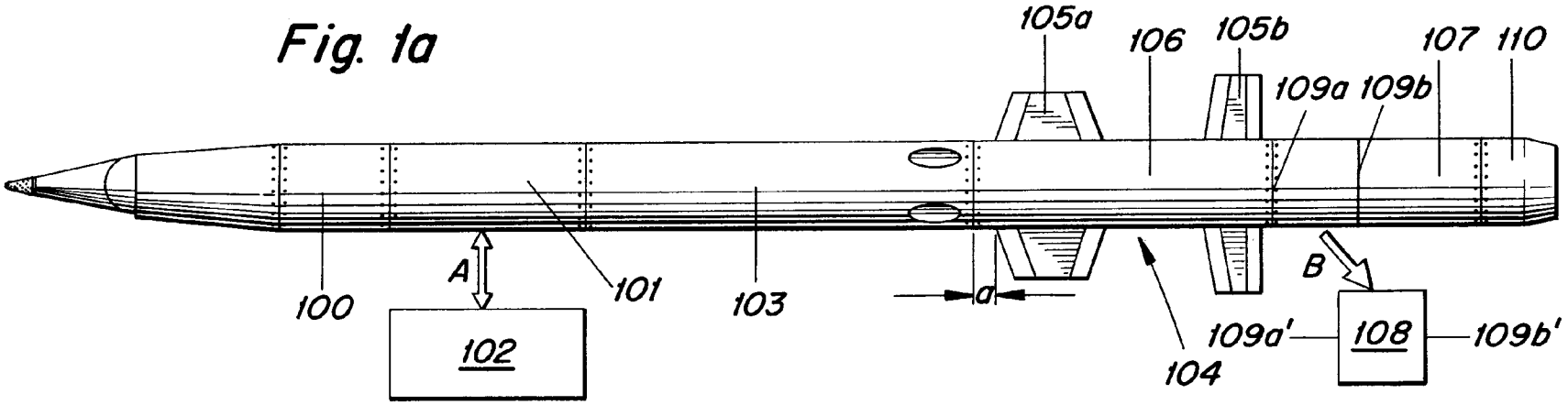

The current invention relates to a missile for combating stationary and/or moving targets consisting of a seeker head, an effective charge that is ranged behind the seeker head in the direction of flight, a doer, such as a solid fuel booster with lateral outlet nozzles, that is arranged behind the effective charge in the direction of flight, and a guiding section that is arranged behind the thruster in the direction of flight. The guiding section has controllable airfoils, such as lateral and/or tall fins, and a guiding device as well as a cruise engine that is arranged on the tail.

A missile of this kind is known in the art, for example, from DE 196 26 075 C1. The known missile is depicted in a cross section in FIG. 2. In the direction of travel it consists of a seeker head 1, a war head 2, a thruster 3 with lateral jet nozzles 32, a central module 4 with a position control system for the airfoils 42, a cruise engine 5 with a gas conduit tube 52, and a launch thruster 6. The characterizing feature of this known missile is the central module with a position control system for folding out or flapping out the airfoils; a first thruster is arranged in a longitudinal direction before central module while a second thruster is arranged in longitudinal direction behind the central module, thereby allowing an adjustment of the thrust profiles and/or energy distribution to a special mission profile, in particular by way of a chronologically clocked ignition of the thrusters.

Also known in the art are a number of constructive realizations of flappable or foldable airfoils which considerably reduce the space that is needed for transporting the missile. For example, from DE 38 38 737 C2 a missile is known in the art in which, using a traction piece, a glide wing holder can be swung from a transport position into a flight position. On the other hand, from DE 39 18 244 C2 we know a missile that uses a lamella-shaped fan as wing.

In addition, the practice of regulating the aerodynamics of missiles by means of a spoiler is known in the art and disclosed, for instance, in DE 42 39 589 A1.

The disadvantageous aspect of the state of the art is, however, that a principal distinction is made between missiles that are suitable for carrying personnel and missiles that can be launched from a weapon's platform. This differentiation is based primarily on the different productive powers, in particular the different firing ranges of the respective guided missiles.

The subject-matter of the present invention is therefore to develop the missile type further, in particular with the purpose in mind of making the missile usable for more varied applications; in particular, on the one hand, as a personnel carrier and, on the other hand, as a missile with increased firing range that can be launched from a weapon's platform. This will result in a higher level of flexibility at the combat site as well as considerable savings.

This objective is achieved by detachably connecting the cruise engine to the guiding section, for example by way of a first quick-acting closure, such as a bayonet closure etc., that can be operated manually; and at least one auxiliary thruster can be integrated between the guiding section and the cruise engine, if required, using at least a second quick-acting closure, such as a bayonet closure etc., that can be operated manually.

It is preferable according to the invention if the airfoils of the guiding section are realized at least in part as flappable, swingable, windable and/or displaceable for the purpose of influencing the center of pressure location and/or the aerodynamic forces and moments, optionally, adjusting to different mission requirements, when installing or removing at least one center-of-gravity-modifying auxiliary thruster, and/or the trimming ascending force properties.

According to the invention is it proposed that the airfoils of the guiding section are at least in part adjustable, in particular axially displaceable, when inserting the auxiliary thruster, specifically for the purpose of adjusting the center of pressure of the guiding device to the missile's point of gravity that has axially shifted due to the installation of the auxiliary thruster.

It is also preferred that the adjustment of the airfoils occurs at least in part automatically when the auxiliary thruster is installed.

The adjustment can be accomplished by way of mechanical coupling of the guiding section containing the airfoils via mechanical identification of the second quick-acting closure with the auxiliary thruster [Note: inconsistent verb inflection in the original].

A characterizing feature of another preferred embodied example of the invention provides that the effective charge is housed as a replaceable effective charge cartridge inside an effective charge compartment. Preferably, the effective charge compartment is opened and closed manually.

It can also be envisioned in this context that for the purpose of the correction of the center of gravity the effective charge cartridge can at least in part be axially shifted to the rear, at the latest after the thruster that is arranged behind the effective charge in the direction of travel is completely burned up.

Moreover, the invention also envisions that the effective charge cartridge can be shifted into the space originally intended for the solid fuel of the solid fuel booster upon and/or after the solid fuel in the solid fuel booster is burned up.

A launch thruster can be arranged in the direction of fight on the tail end of the cruise engine.

Thus, the invention is based on the surprising realization that an auxiliary thruster, even if only for a short time and even if adjusted to the respective combat situation in the field, can easily be installed or removed from between a guiding section and a cruise engine in order to obtain a missile that can either be launched from a platform or that is suitable to carry personnel.

It is particularly advantageous if the shift of the center of gravity, which occurs depending on whether or not the auxiliary thruster is integrated, is compensated for by the displacement of the airfoils according to the invention.

Another preferred embodied example of the invention envisions that, in terms of making adjustments to the desired mission, a quick replacement of the respective effective charge cartridge is possible in the field, because the effective charge cartridge is positioned, quickly replaceable, inside an effective charge compartment.

According to the invention the exact position of the effective charge cartridge can also be utilized to adjust the point of gravity.

Figure 1B:
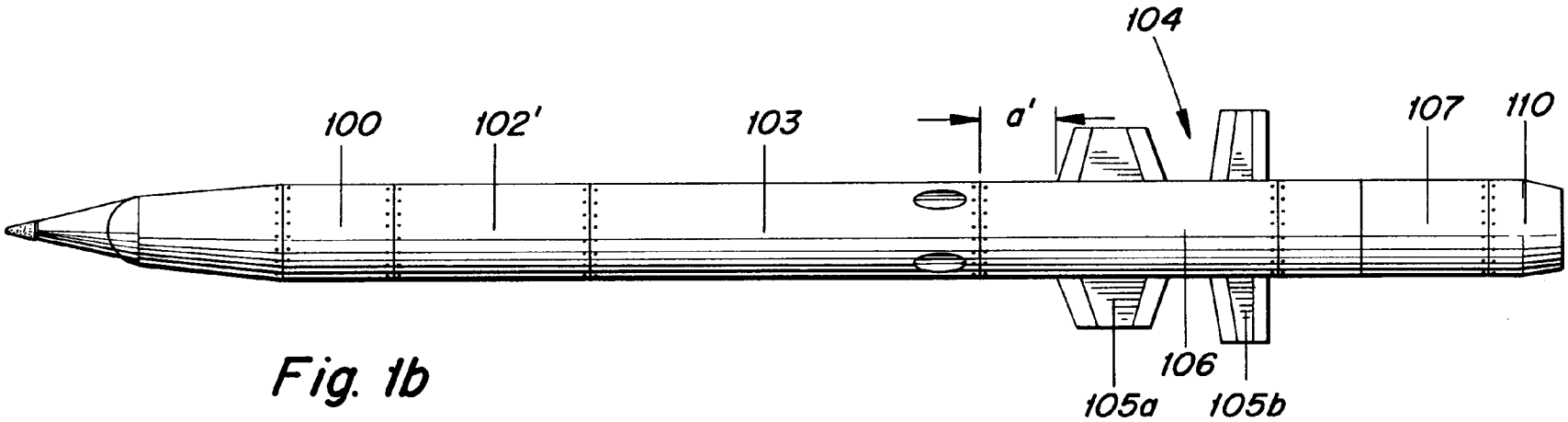
Figure 2:
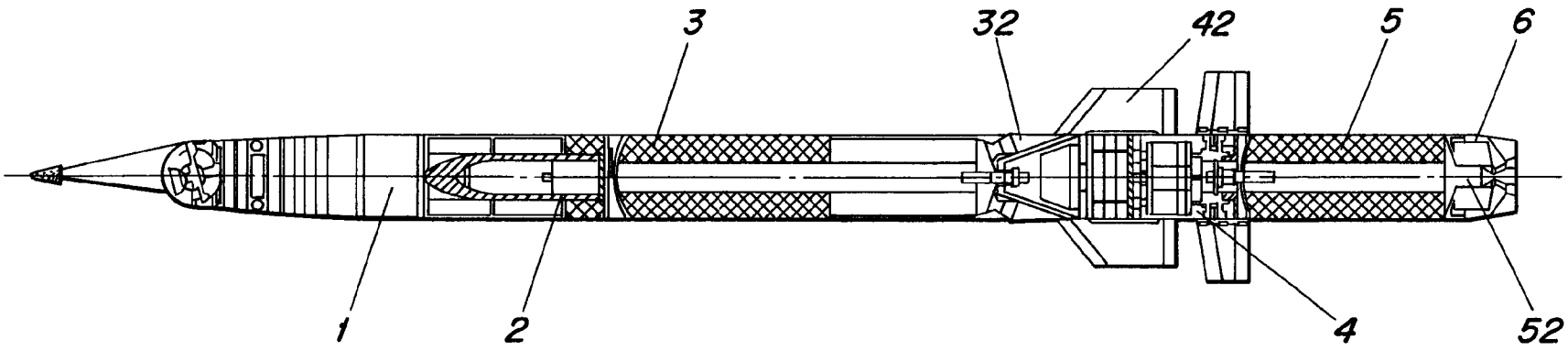
Fig. 2 PRIOR ART

Other characterizing features and advantages of the invention can be derived from the subsequent description which, using schematic drawings, explains two embodiments of the invention in detail, Shown are in:

FIG. 1*a* a cross section of a missile that can be launched from a platform and that can be reconstructed into a missile suitable for carrying personnel by removing the auxiliary thruster;

FIG. 1*b* a cross section of a missile that is suitable for carrying personnel and that was obtained following reconstruction of the missile shown in FIG. 1*a*; and FIG. 2 a cross section of a missile that is known in the art.

As shown in FIG. 1*a*, in the direction of flight, a missile according to the invention consists of a seeker head 100, an effective charge compartment 101 intended for an effective charge cartridge 102, a solid fuel booster 103, a guiding section 104 with controllable airfoils 105*a*, 105*b* on a guiding device 106, an auxiliary thruster 108 that can be installed using the quick-acting closures 109*a*, 109*b*, 109*a*', 109*b*', and a cruise engine 107 with a launch thruster 110. The missile in accordance with FIG. 1*a* containing the effective charge cartridge 102 and having the auxiliary thruster 108 in mounted operational position is suitable for launch from a weapon's platform, such as can be found, for instance on tanks.

However, if the combat situation requires it, for example due to the geographic characteristics of the terrain that the missile indicated in FIG. 1*a* is made available as quickly as possible to a soldier who is part of a scouting troupe, the missile can be converted as follows and directly in the field:

The effective charge cartridge 102 can be removed manually from the effective charge compartment 101, as symbolized in FIG. 1*a* with arrow A, and replaced with another effective charge cartridge 102', as seen in FIG. 1*b*.

The auxiliary thruster 108 can be uninstalled from the missile using the quick-acting closures 109*a*, 109*a*' in relation to the guiding section 104 and using the quick-acting closures 109*b*, 109*b*' in relation to the cruise engine 107; this way the cruise engine 197 [sic] can be attached directly to the guiding section 104 via the quick-acting closures 109*a*, 109*b*, as shown in FIG. 1*b*.

Uninstalling the auxiliary thruster 108 naturally causes a shift of the center of gravity that can be compensated for with a longitudinal shift of the airfoils 105*a*; this means the distance between the front side of the airfoils 105, located in the direction of travel, and the solid fuel booster 103 is increased from the distance a for the missile shown in FIG. 1*a*, which is to be launched from a platform, to the distance a' for the missile shown in FIG. 1*b*, which is suitable for carrying personnel.

Moreover, with the missile according to FIG. 1*a* as well as with the missile according to FIG. 1*b* a correction of the point of gravity can occur during the burn-up process, in particular when the fuel in the solid fuel booster 103 is burned up, effected by an axial shift to the rear in the direction of flight of the effective charge cartridge 102, 102'.

The characterizing features of the invention that are disclosed in the previous description, in the drawings, and in the claims can be essential individually and in any combination for the realization of the invention in its different embodied examples.

What is claimed is:

1. Missile for combating targets, comprising:

a seeker head, an effective charge arranged behind the seeker head with reference to the direction of flight, a thruster arranged behind the effective charge with reference to the direction of flight, a guidance section arranged behind the thruster with reference to the direction of flight, with the guidance section having controllable airfoils and a guidance device, and a cruise engine detachably connected with the guidance section by a first quick-acting closure that is manually operable at a combat site, to enable at least one auxiliary thruster to be integrated between the guidance section and the cruise engine by a second quick-acting closure that is manually operable at the combat site.

2. Missile as claimed in claim 1 wherein the airfoils are adjustable to compensate for changes in a center of gravity of the missile.

3. Missile as claimed in claim 2 wherein the airfoils are adjustable automatically in response to insertion of the auxiliary thruster.

4. Missile as claimed in claim 3 wherein the automatic adjustment of the airfoils occurs in response to a mechanical coupling of the guidance section containing the airfoils by a mechanical identification of the second quick-acting closure with the auxiliary thruster.

5. Missile as claimed in claim 1 wherein the effective charge comprises a replaceable effective charge cartridge disposed inside an effective charge compartment.

6. Missile as claimed in claim 5 wherein the effective charge compartment is manually operable and closable.

7. Missile as claimed in claim 5 wherein the effective charge cartridge is rearwardly shiftable to change a center of gravity of the missile when the thruster is burned up completely.

8. Missile as claimed in claim 5 wherein the thruster includes a fuel space containing solid fuel, the effective charge cartridge being shiftable into the fuel space when the solid fuel has burned up.

9. Missile as claimed in claim 1, further including a launch thruster arranged at a tail end of the cruise engine.

* * * * *